US009574251B2

(12) United States Patent
Iwami et al.

(10) Patent No.: US 9,574,251 B2
(45) Date of Patent: Feb. 21, 2017

(54) METHOD OF PRODUCING SINTERED ORE

(71) Applicant: JFE Steel Corporation, Tokyo (JP)

(72) Inventors: Yuji Iwami, Tokyo (JP); Tetsuya Yamamoto, Tokyo (JP); Koichi Nushiro, Tokyo (JP); Yohei Takigawa, Tokyo (JP)

(73) Assignee: JFE Steel Corporation (JP)

( * ) Notice: Subject to any disclaimer, the term of this patent is extended or adjusted under 35 U.S.C. 154(b) by 114 days.

(21) Appl. No.: 14/405,908

(22) PCT Filed: Nov. 20, 2012

(86) PCT No.: PCT/JP2012/080036

§ 371 (c)(1),
(2) Date: Dec. 5, 2014

(87) PCT Pub. No.: WO2013/186950

PCT Pub. Date: Dec. 19, 2013

(65) Prior Publication Data

US 2015/0167115 A1 Jun. 18, 2015

(30) Foreign Application Priority Data

Jun. 13, 2012 (JP) ..... 2012-133658

(51) Int. Cl.
*C22B 1/20* (2006.01)

(52) U.S. Cl.
CPC ..... *C22B 1/20* (2013.01); *C22B 1/205* (2013.01)

(58) Field of Classification Search
CPC ..... C22B 1/20; C22B 1/205
See application file for complete search history.

(56) References Cited

FOREIGN PATENT DOCUMENTS

| | | |
|---|---|---|
| EP | 2 365 101 | 9/2011 |
| EP | 2 371 975 | 10/2011 |
| JP | 46-27126 | 8/1971 |
| JP | 48-18102 | 3/1973 |
| JP | 55-18585 | 2/1980 |
| JP | 55018585 A * | 2/1980 |
| JP | 5-311257 | 11/1993 |
| JP | 2008-291354 | 12/2008 |

(Continued)

OTHER PUBLICATIONS

Oyama et al. JP 2010-106342A published May 13, 2010. Machine translation.*

(Continued)

*Primary Examiner* — George Wyszomierski
*Assistant Examiner* — Tima M McGuthry Banks
(74) *Attorney, Agent, or Firm* — DLA Piper LLP (US)

(57) ABSTRACT

A method of producing a sintered ore includes charging a sintering raw material containing a powder ore and a carbonaceous material onto a circulatory moving pallet to form a charged layer, igniting the carbonaceous material on a surface of the charged layer, introducing air above the charged layer containing a gaseous fuel diluted to not more than a lower limit of combustion concentration with wind boxes arranged below the pallet into the charged layer by suction, and combusting the gaseous fuel and the carbonaceous material in the charged layer, wherein more than 50% of a total supply of the gaseous fuel is supplied in a front ½ portion of a region supplying the gaseous fuel.

4 Claims, 7 Drawing Sheets

(56) References Cited

FOREIGN PATENT DOCUMENTS

| | | |
|---|---|---|
| JP | 2010-47801 | 3/2010 |
| JP | 2010-106342 | 5/2010 |
| WO | 2007/052776 | 5/2007 |
| WO | 2011/118822 | 9/2011 |

OTHER PUBLICATIONS

Nakamura, Masaru. JP 55018585 A published Feb. 1980. Machine translation.*

Australian Patent Examination Report No. 1 dated Jul. 27, 2015 of corresponding Australian Application No. 2012382543.

Taiwanese Office Action dated Jun. 2, 2015 from corresponding Taiwanese Patent Application No. 101144488 along with an English translation.

Supplementary European Search Report dated Jul. 2, 2015 of corresponding European Application No. 12878925.2.

Chinese Office Action dated Mar. 22, 2016, of corresponding Chinese Application No. 201280073945.5, along with a Concise Statement of Relevance of Office Action in English.

Korean Office Action dated Apr. 21, 2016, of corresponding Korean Application No. 10-2014-7032237, along with a Concise Statement of Relevance of Office Action in English.

"Mineral Engineering," edited by Hideki Imai, Sukune Takenouchi, Yoshinori Fujiki, *Asakura Publishing Co., Ltd.*, 1976, p. 175 w/ English Translation.

First Notification of Office Action dated Sep. 25, 2015 of corresponding Chinese Patent Application No. 201280073945.5 along with an English translation.

Notice of Preliminary Rejection dated Nov. 20, 2015 of corresponding Korean Patent Application No. 10-2014-7032237 along with an English translation.

Japanese Office Action dated Jul. 13, 2016, of corresponding Japanese Application No. 2014-521192, along with a Concise Statement of Relevance of Office Action in English.

Korean Office Action dated Jul. 25, 2016, of corresponding Korean Application No. 10-2014-7032237, along with a Concise Statement of Relevance of Office Action in English.

* cited by examiner

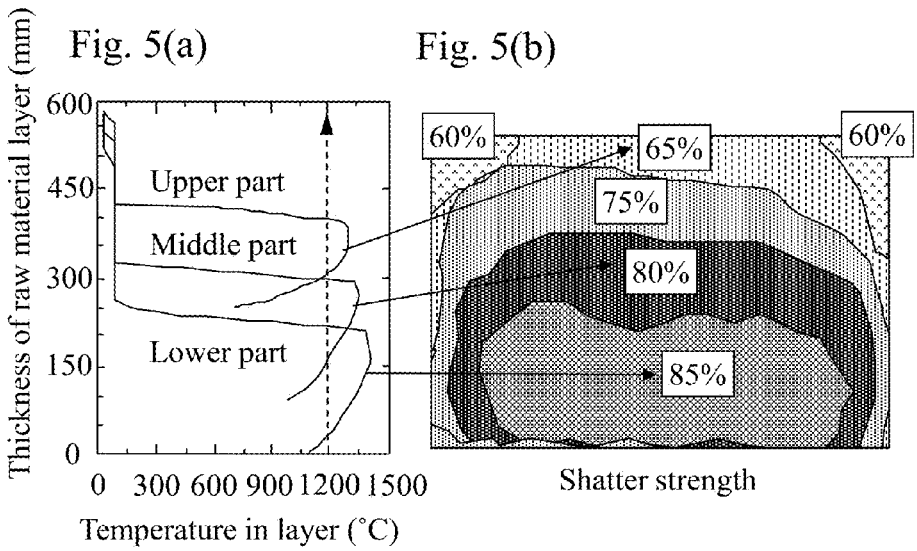
FIG. 6
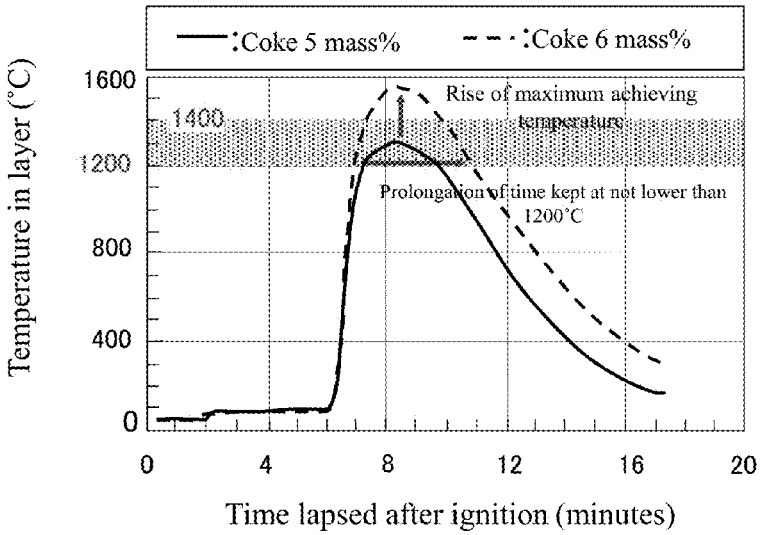

FIG. 13
| Level | Condition A , (Condition B) | Condition C |
|---|---|---|
| Condition of supplying town gas | Condition A: 0.25 vol% 6minutes (Condition B: 0.31 vol% 2 minutes+0.25vol% 2 minuets +0.19 vol% 2 minutes) | 0.40 vol% 2 minutes + 0.18 vol% 4 minutes |
| Heat pattern | 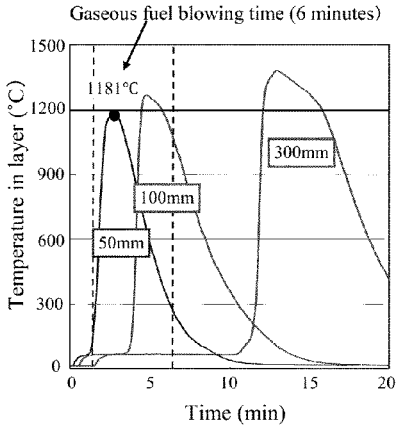 | 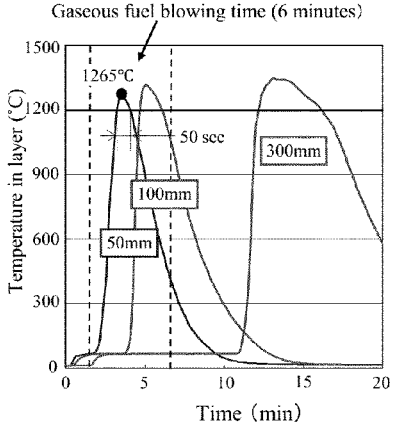 |
Fig. 14(a)
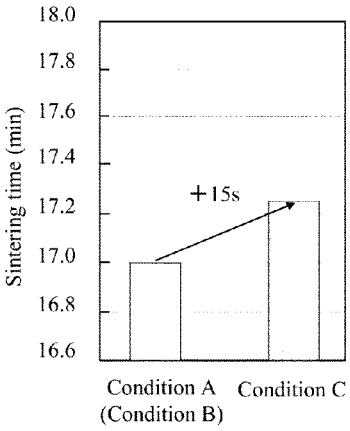
Fig. 14(b)
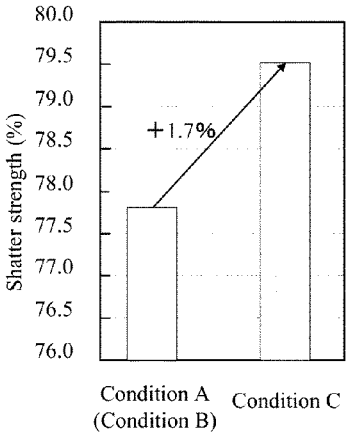
Fig. 14(c)
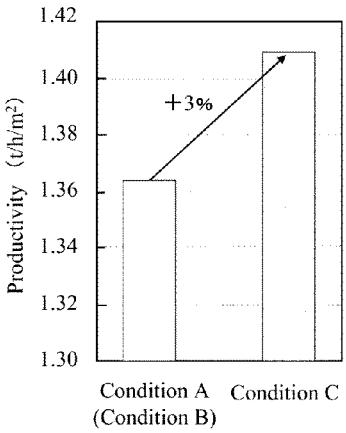

METHOD OF PRODUCING SINTERED ORE

TEHCNICAL FIELD

This disclosure relates to a method for a high-quality sintered ore as a raw material for blast furnaces having a high strength and an excellent reducibility with a downdraft type Dwight-Lloyd sintering machine.

BACKGROUND

In general, sintered ore as a main raw material for a blast furnace iron-making method is produced through the process as shown in FIG. 1. The raw material for the sintered ore includes iron ore powder, under-sieve fines of sintered ore, recovery powder generated in the ironworks, a CaO-containing auxiliary material such as limestone, dolomite or the like, a granulation auxiliary agent such as quicklime or the like, coke powder, anthracite and so on, which are cut out from respective hoppers 1 onto a conveyer at a predetermined ratio. The cut-out raw materials are added with a proper amount of water, mixed and granulated in drum mixers 2 and 3 to form quasi-particles having a mean particle size of 3~6 mm as a sintering raw material. Then, the sintering raw material is charged onto a pallet 8 of a continuous type sintering machine at a thickness of 400~800 mm from surge hoppers 4 and 5 disposed above the sintering machine through a drum feeder 6 and a cutout chute 7 to form a charged layer 9 also called as a sintering bed. Thereafter, carbonaceous material in a surface part of the charged layer is ignited by an ignition furnace 10 disposed above the charged layer 9, while air above the charged layer is sucked downwardly through wind boxes 11 located just beneath the pallet 8 to thereby combust the carbonaceous material in the charged layer sequentially, and the sintering raw material is melted by combustion heat generated at this time to obtain a sintered cake. The thus obtained sintered cake is then crushed, granulated and agglomerates of about not less than 5 mm in size are collected as a product sintered ore and supplied into the blast furnace.

In the above production process, the carbonaceous material in the charged layer ignited by the ignition furnace 10 is thereafter continuously combusted by air sucked from top down through the charged layer to form a combustion·molten zone having a certain width in a thickness direction (hereinafter referred to as "combustion zone"). The molten portion of the combustion zone obstructs the flow of the sucked air, which is a factor of causing an extension of the sintering time to decrease productivity. Also, the combustion zone is gradually moved from the upper part to the lower part of the charged layer as the pallet 8 moves downstream, and a sintered cake layer finishing the sintering reaction (hereinafter referred to as "sintering layer") is formed in a portion after passing the combustion zone. Further, as the combustion zone is transferred from the upper part to the lower part, moisture included in the sintering raw material is vaporized by combustion heat of the carbonaceous material and condensed into the sintering raw material in the lower part not yet raising the temperature to form a wet zone. When the water concentration exceeds a certain degree, voids among the particles of the sintering raw material as a path of the gas sucked are filled with water, which is a factor of increasing airflow resistance like the molten zone.

The production volume by the sintering machine (t/hr) is generally determined by productivity (t/hr·m$^2$)×area of the sintering machine (m$^2$). That is, the production volume by the sintering machine is varied depending on width and length of the sintering machine, thickness of a charged layer of the raw material, bulk density of the sintering raw material, sintering (combustion) time, yield and the like. To increase the production volume of the sintered ore, therefore, it is believed that it is effective to shorten the sintering time by improving air permeability of the charged layer (pressure loss) or to increase the yield by increasing the cold strength of the sintered cake before crushing.

FIG. 2 shows distributions of pressure loss and temperature in the charged layer when a combustion zone moving in the charged layer of 600 mm in thickness is located at a position of about 400 mm above the pallet in the charged layer (200 mm below the surface of the charged layer). The pressure loss distribution shows 60% in the wet zone and 40% in the combustion zone.

FIG. 3 shows a transition of temperature and time at a certain point in the charged layer at high and low productivity of the sintered ore, or at fast and slow moving speed of a pallet in the sintering machine, respectively. The time kept at a temperature of not lower than 1200° C. starting the melting of sintering raw material particles is represented by $T_1$ in the low productivity and $T_2$ in the high productivity, respectively. In the high productivity, the moving speed of the pallet is fast so that the high-temperature keeping time $T_2$ becomes short as compared to $T_1$ in the low productivity. However, as the time kept at a high temperature of not lower than 1200° C. is shortened, the sintering becomes insufficient. Hence, the cold strength of the sintered ore is decreased to lower the yield. Consequently, to produce the high-strength sintered ore in a short time with a high yield and a good productivity, it is required to take some measures to prolong the time kept at a high temperature of not lower than 1200° C. to increase the cold strength of the sintered ore.

FIG. 4 is a schematic view illustrating a process wherein the carbonaceous material in the surface part of the charged layer ignited by the ignition furnace is continuously combusted by the sucked air to form the combustion zone, which is moved from the upper part to the lower part of the charged layer sequentially to form the sintered cake. Also, FIG. 5(*a*) is a schematic view illustrating a temperature distribution when the combustion zone exists in each of an upper part, a middle part and a lower part of the charged layer within a thick frame shown in FIG. 4. The strength of the sintered ore is affected by the product of the temperature of not lower than 1200° C. and the time kept at this temperature, and as the value becomes larger, the strength of the sintered ore becomes higher. Accordingly, the middle and lower parts in the charged layer are pre-heated by combustion heat of the carbonaceous material in the upper part of the charged layer carried with the sucked air and thus kept at a high temperature for a long time, whereas the upper part of the charged layer is lacking in the combustion heat due to no preheating. Hence, combustion melting reaction required for sintering (sintering reaction) is liable to be insufficient. As a result, the yield of the sintered ore in the widthwise section of the charged layer becomes smaller at the upper part of the charged layer as shown in FIG. 5(*b*). Moreover, both widthwise end portions of the pallet are supercooled due to heat dissipation from the side walls of the pallet or a large amount of air passed so that the high-temperature keeping time required for sintering cannot be secured sufficiently and the yield is also lowered.

As to these problems, it has hitherto been performed to increase the amount of the carbonaceous material (powdery coke) added in the sintering raw material. However, it is possible to raise the temperature in the sintered layer and prolong the time kept at not lower than 1200° C. by increasing the addition amount of coke as shown in FIG. 6, while at the same time, the maximum achieving temperature in the sintering exceeds 1400° C. and the decrease of the reducibility and cold strength of the sintered ore is caused by the reason as described below.

In Table 1 of 'Mineral engineering', edited by Hideki IMAI, Sukune TAKENOUCHI, Yoshinori FUJIKI, (1976), p. 175, Asakura Publishing Co., Ltd. are shown tensile strength (cold strength) and reducibility of various minerals generated in the sintered ore during the sintering. In the sintering process, a melt starts to be generated at 1200° C. to produce calcium ferrite having the highest strength and a relatively high reducibility among constitutional minerals of the sintered ore as shown in FIG. 7. This is the reason why the sintering temperature is required to be not lower than 1200° C. However, when the temperature is further raised and exceeds 1400° C., precisely 1380° C., calcium ferrite starts to be decomposed into an amorphous silicate (calcium silicate) having the lowest cold strength and reducibility and a secondary hematite of a skeleton-crystal form easily causing reduction degradation. Also, the secondary hematite constituting a start point of the reduction degradation of the sintered ore raises the temperature up to a zone of Mag. ss+Liq. and is precipitated in the cooling as shown in a phase diagram of FIG. 8 from the results of the mineral synthesis test so that production of the sintered ore through a path (2) instead of a path (1) shown in the phase diagram is considered to be important to suppress the reduction degradation.

TABLE 1

| Type of mineral | Tensile strength (MPa) | Reducibility (%) |
|---|---|---|
| Hematite | 49 | 50 |
| Magnetite | 58 | 22 |
| Calcium ferrite | 102 | 35 |
| Calcium silicate | 19 | 3 |

That is, 'Mineral engineering', edited by Hideki IMAI, Sukune TAKENOUCHI, Yoshinori FUJIKI, (1976), p. 175, Asakura Publishing Co., Ltd. discloses that in controlling the maximum achieving temperature, the high-temperature keeping time and the like during combustion is a very important control item to ensure the quality of the sintered ore and the quality of the sintered ore is substantially determined depending on these controls. Therefore, to obtain a sintered ore having a high strength and excellent reduction degradation index (RDI) and reducibility, it is important that calcium ferrite produced at a temperature of not lower than 1200° C. is not decomposed into calcium silicate and secondary hematite. To this end, it is necessary that the maximum achieving temperature in the charged layer during sintering does not exceed 1400° C., preferably 1380° C., while the temperature in the charged layer is kept at not lower than 1200° C. (solidus temperature of calcium ferrite) for a long time. The time kept in the temperature range of not lower than 1200° C., but not higher than 1400° C. is hereinafter called as "high-temperature keeping time".

Moreover, there are proposed some techniques for the purpose of keeping the upper part of the charged layer at a high temperature for a long time. For example, JP-A-S48-018102 proposes a technique of injecting gaseous fuel onto the charged layer after the ignition of the charged layer, JP-B-S46-027126 proposes a technique of adding a flammable gas to air sucked into the charged layer after ignition of the charged layer, JP-A-S55-018585 proposes a technique wherein a hood is disposed above the charged layer and a mixed gas of air and coke oven gas is jetted from the hood at a position just behind the ignition furnace to make the temperature in the charged layer of the sintering raw material higher, and JP-A-H05-311257 proposes a technique of simultaneously blowing a low-melting point flux and carbonaceous material or flammable gas at a position just behind the ignition furnace.

In those techniques, however, since gaseous fuel with a high concentration is used and the amount of the carbonaceous material is not decreased in blowing the gaseous fuel, the maximum achievable temperature of the charged layer in the sintering becomes high exceeding 1400° C. as an upper limit temperature under operation control so that calcium ferrite produced in the sintering process is decomposed to form a sintered ore having low reducibility and cold strength. Hence, the effect of improving the yield is not obtained or the air permeability is deteriorated due to the temperature rising and thermal expansion by the combustion of the gaseous fuel to decrease the productivity, or further there is a risk of causing fire accident in the upper space of the sintering bed (charged layer) with the use of the gaseous fuel. As a result, any of these techniques are not brought into practical use.

When the techniques disclosed in WO 2007/052776, JP-A-2010-047801, JP-A-2008-291354 and JP-A-2010-106342 are applied to the method of producing the sintered ore with the downdraft type sintering machine to decrease the amount of the carbonaceous material added to the sintering raw material and further the gaseous fuel diluted to not higher than the lower limit concentration of combustion is introduced into the charged layer to combust the gaseous fuel in the charged layer as shown in FIG. 9, the gaseous fuel is combusted in the charged layer (in the sintering layer) after combustion of the carbonaceous material so that the width of the combustion·molten zone can be enlarged into the thickness direction without exceeding the maximum achieving temperature over 1400° C. and hence the high-temperature keeping time can be prolonged.

To produce the high-quality sintered ore having a high strength and an excellent reducibility in a high yield, it is required to ensure the time kept at a high temperature range of not lower than 1200° C. but not higher than 1400° C. (high-temperature keeping time) at least for not less than the predetermined time, whereas even if the keeping time is prolonged excessively from the predetermined time, the effect is saturated. To this end, the high-temperature keeping time is desirable to be not less than the predetermined value and uniform over the full area of the charged layer in the thickness direction as shown by a dashed line in FIG. 10. However, the techniques of WO 2007/052776, JP-A-2010-047801 and JP-A-2008-291354 have an effect of uniformizing the high-temperature keeping time in an area getting inside from the surface portion of the charged layer of the sintering raw material to a certain level as shown in FIG. 10, while it is difficult to ensure the high-temperature keeping time of not less than the predetermined value in an area ranging from the surface of the raw material charged layer to about 30% of the layer thickness because the carbonaceous material is decreased in the operation by supplying the gaseous fuel and further the area is cooled by air introduced into the charged layer. Therefore, the yield in the surface portion of the raw material charged layer is somewhat improved by the supply of the gaseous fuel, but the effect is limited. The technique of JP-A-2010-106342 proposes that the concentration of the diluted gaseous fuel to be supplied is made higher in an upstream side of the supplied area than that in the downstream side in the operation by supplying the gaseous fuel. However, the area ranging from the surface of the raw material charged layer to about 30% of the layer thickness is cooled by air introduced into the charged layer after the ignition, so that the high-temperature keeping time cannot be ensured sufficiently, and consequently the effect by supplying the gaseous fuel into the surface portion of the raw material charged layer is limited as in WO 2007/052776, JP-A-2010-047801 and JP-A-2008-291354.

We developed a technique of intensively supplying the gaseous fuel into such an area of the raw material charged layer that the time kept at a high temperature range of not lower than 1200° C. (high-temperature keeping time) is less than 150 seconds in case of sintering by combustion heat of only the carbonaceous material, the result of which is filed as Japanese Patent Application No. 2011-054513. In that technique, however, although the length of the gaseous fuel supplied (supplying position) is varied, when the concentration of the gaseous fuel supplied is constant or when the concentration of the gaseous fuel is made higher in the upstream side of the supplied area than that in the downstream side thereof as described in JP-A-2010-106342, it is actual that the maximum achieving temperature in the sintering is still lower than 1200° C. in the outermost surface portion within 100 mm from the surface of the raw material charged layer, or even if it reaches the above value, the high-temperture keeping time is difficult to be ensured for a long time.

It could therefore be helpful to provide a method of producing a sintered ore wherein the time kept at a high-temperature range is stably ensured even in the outermost surface portion of the sintering raw material charged layer and hence a high-quality sintered ore having a high strength and an excellent reducibility can be produced in a high yield.

SUMMARY

We found that to solve the shortage of heat quantity in the outermost surface portion of the sintering raw material charged layer, when the gaseous fuel having the same heat quantity is supplied, it is effective to supply a gaseous fuel of a high concentration intensively in the sintering reaction of the outermost surface portion without supplying the gaseous fuel at a constant concentration for a given time.

1. We thus provide a method of producing a sintered ore by charging a sintering raw material containing a powder ore and a carbonaceous material onto a circulatory moving pallet to form a charged layer, igniting the carbonaceous material on the surface of the charged layer, introducing air above the charged layer containing a gaseous fuel diluted to not more than a lower limit of combustion concentration with wind boxes arranged below the pallet into the charged layer by suction and combusting the gaseous fuel and the carbonaceous material in the charged layer, characterized in that more than 50% of a total supply of the gaseous fuel is supplied in a front ½ portion of a region supplying the gaseous fuel.

2. The method of producing a sintered ore of 1 is characterized in that more than 65% of the total supply of the gaseous fuel is supplied in the front ½ portion of the region supplying the gaseous fuel.

3. The method of producing a sintered ore of 1 is characterized in that more than 40% of the total supply of the gaseous fuel is supplied in the front ⅓ portion of the region supplying the gaseous fuel.

4. The method of producing a sintered ore of 1 is characterized in that more than 50% of the total supply of the gaseous fuel is supplied in the front ⅓ portion of the region supplying the gaseous fuel.

5. The method of producing a sintered ore of 1 is characterized that the region supplying the gaseous fuel is a region wherein a high-temperature keeping time kept at not lower than 1200° C. but not higher than 1380° C. is less than 150 seconds when the region is sintered by combustion heat of only the carbonaceous material.

6. The method of producing a sintered ore of 1 is characterized in that the region supplying the gaseous fuel is not more than 40% of a machine length ranging from an ignition furnace to an ore removing portion.

7. The method of producing a sintered ore of 1 is characterized in that the concentration of the gaseous fuel contained in air introduced in the charged layer is not more than the lower limit of combustion concentration.

It is possible to keep the maximum achievable temperature in the sintering at a high-temperature range for a long time in substantially a full area in the charged layer so that the high-quality sintered ore having a high strength and an excellent reducibility can be produced in a high yield. Also, the amount of the carbonaceous material added to the sintering raw material can be decreased, which can contribute to the reduction in the amount of carbon dioxide discharged.

BRIEF DESCRIPTION OF THE DRAWINGS

FIGS. 5(*a*) and (*b*) are views illustrating a temperature distribution when a combustion zone is existent in each position of an upper portion, a middle portion and a lower portion of a charged layer and a yield distribution of a sintered ore in a widthwise section of the charged layer.

FIG. 6 is a view illustrating a temperature change in a charged layer according to a change (increase) in an amount of a carbonaceous material.

FIG. 13 is a graph showing a temperature history at depth positions of 50 mm, 100 mm and 300 mm from a surface of a raw material charged layer in sintering experiments under conditions of FIG. 12, respectively.

FIGS. 14(*a*)-(*c*) are graphs showing experimental results (sintering time, shatter strength, productivity) in sintering experiments under conditions of FIG. 12.

DESCRIPTION OF REFERENCE SYMBOLS

Figure 1:
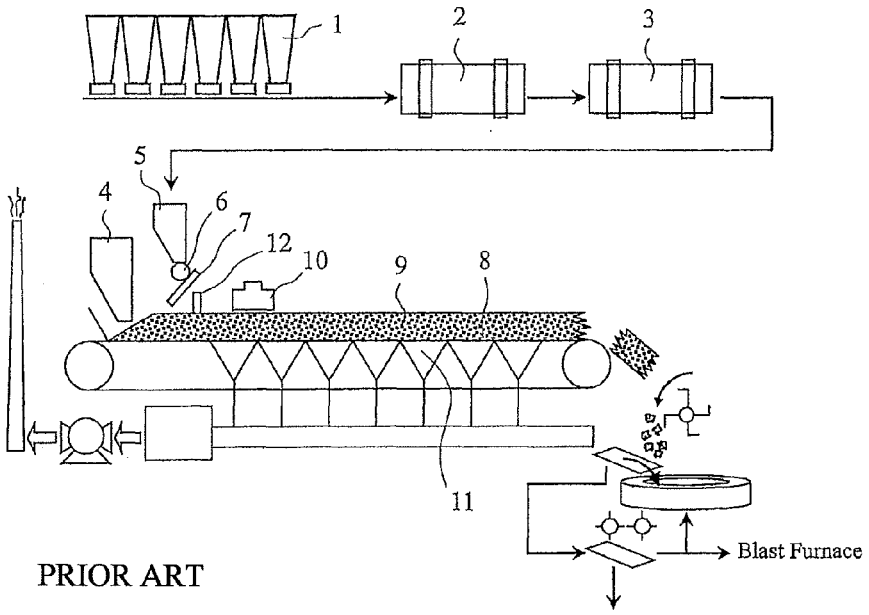
FIG. 1 is a schematic view illustrating a known sintering process.
Figure 2:
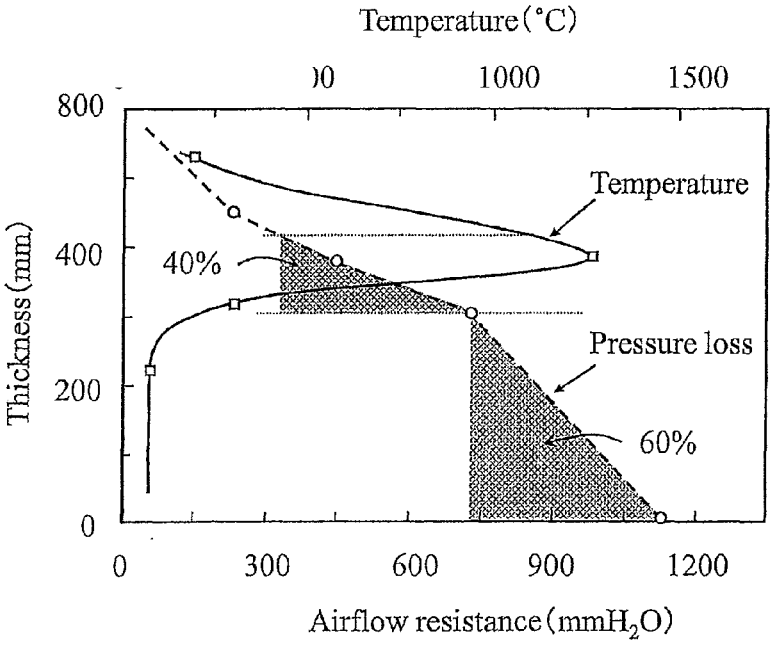
PRIOR ART FIG. 2
FIG. 2 is a graph showing a pressure loss distribution in a charged layer in the sintering.
Figure 3:
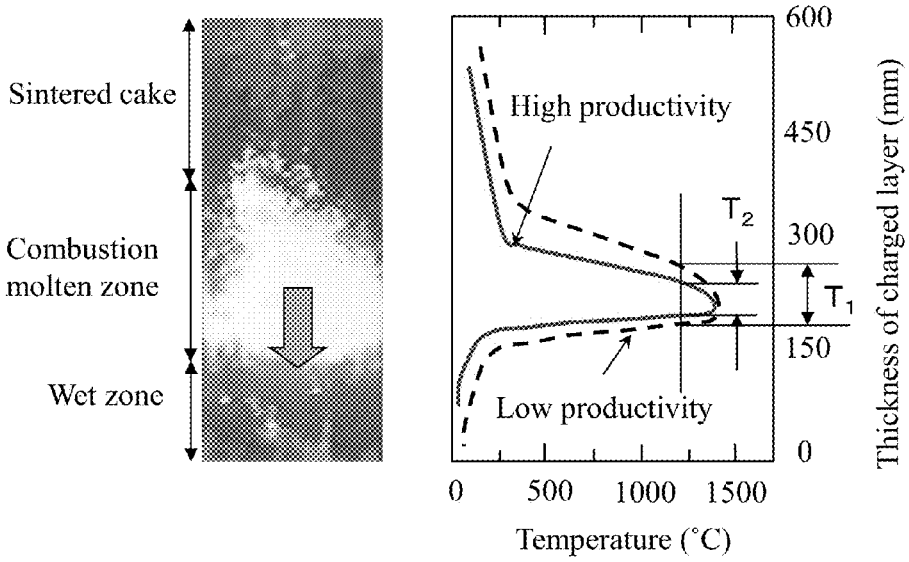
FIG. 3 is a graph showing a temperature distribution in a charged layer at a high productivity and a low productivity, respectively.
Figure 4:
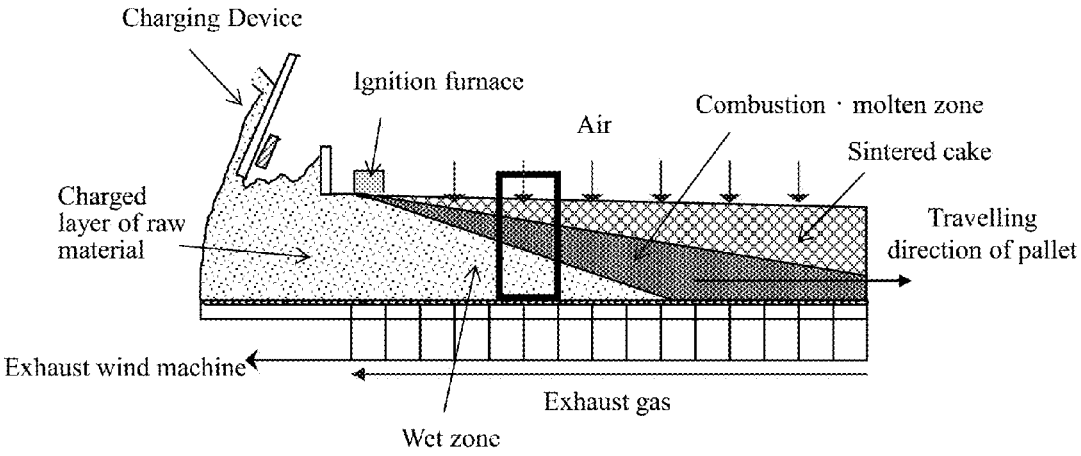
FIG. 4 is a schematic view illustrating a change inside a charged layer with the advance of the sintering progress.
Figure 7:
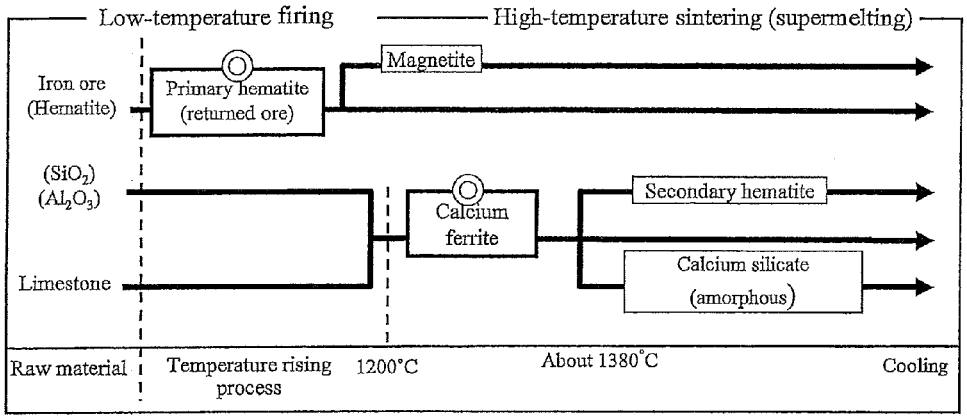
FIG. 7 is a view illustrating a sintering reaction.
Figure 8:
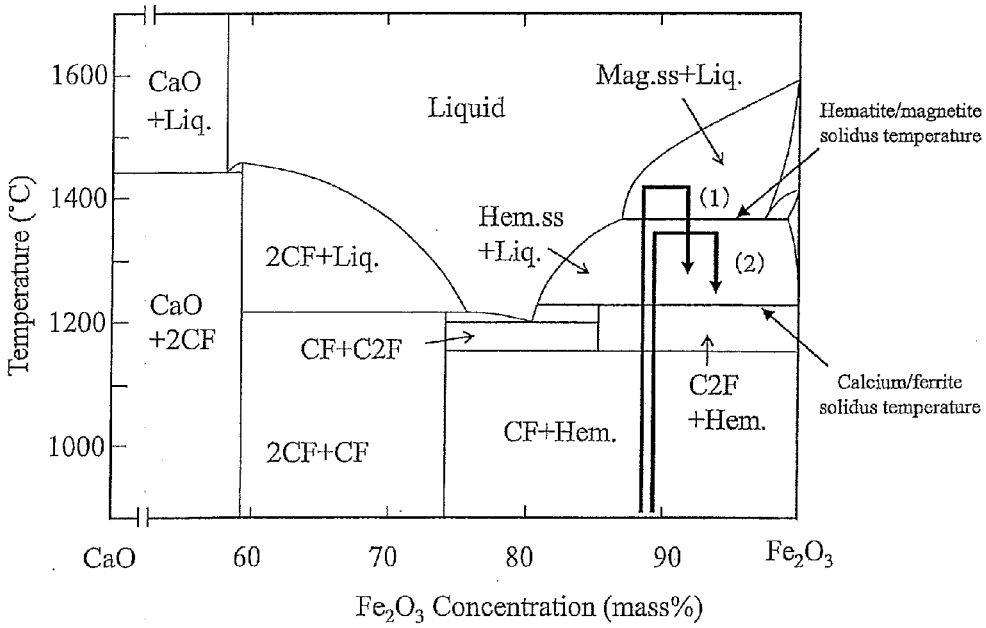
FIG. 8 is a phase diagram illustrating a process of producing a secondary hematite of a skeleton-crystal form.
Figure 9A:
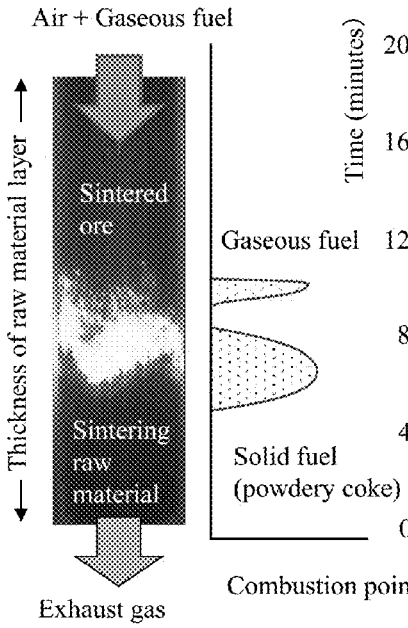
FIGS. 9(*a*) and (*b*) are schematic views illustrating an effect of a gaseous fuel supply on a high-temperature keeping time.
Figure 9B:
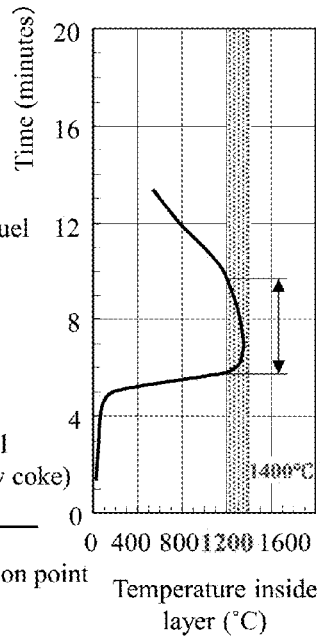
Figure 10:
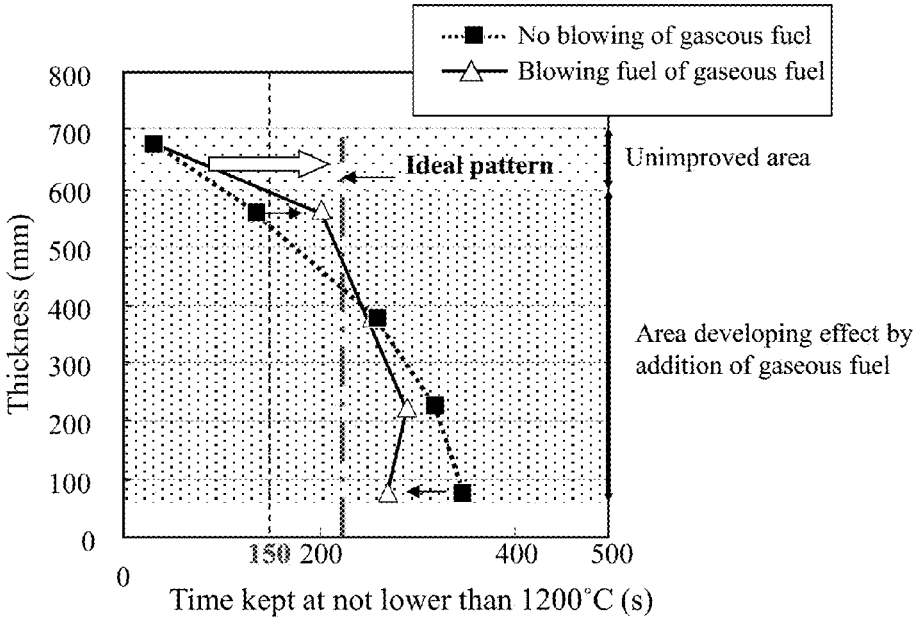
FIG. 10 is a graph showing an influence of a gaseous fuel supply on a distribution of a high-temperature keeping time in a thickness direction of a charged layer.

1: hopper for raw material
2, 3: drum mixer
4: hopper for floor-bedded ore
5: surge hopper
6: drum feeder
7: cutout chute
8: pallet
9: charged layer
10: ignition furnace
11: wind box (wind box)
12: cut-off plate

DETAILED DESCRIPTION

As a technique to address the above issues, we proposed a technique wherein both of the maximum achieving temperature and the high-temperature keeping time in the charged layer are controlled within adequate ranges by decreasing the amount of the carbonaceous material added in the sintering raw material and introducing various gaseous fuels diluted to not more than the lower limit concentration of combustion into the charged layer from above the pallet in an area located at downstream side of the ignition furnace of the sintering machine and at a front half of the length of the sintering machine to perform combustion in the charged layer.

We conducted the following experiments to study a method of supplying a gaseous fuel which is the most effective to raise a temperature during the sintering in an outermost surface portion of a sintering raw material charged layer in supplying the gaseous fuel of the same heat generation amount.

At first, when the sintering is conducted by depositing a raw sintering material added with 5.0 mass % of a carbonaceous material (powdery coke) at a thickness of 400 mm onto a pallet of a sintering machine, igniting a surface portion thereof in an ignition furnace and then sucking air under a negative pressure of 1000 $mmH_2O$ with wind boxes installed below the pallet, assuming that a natural gas (LNG) as a gaseous fuel is supplied for 6 minutes after 30 seconds of the ignition (corresponding to about 35% of the total sintering time), the temperature change in the sintering at a depth position of 50 mm from the surface of the charged layer is simulated using a sintering one-dimensional model.

Figure 11A:
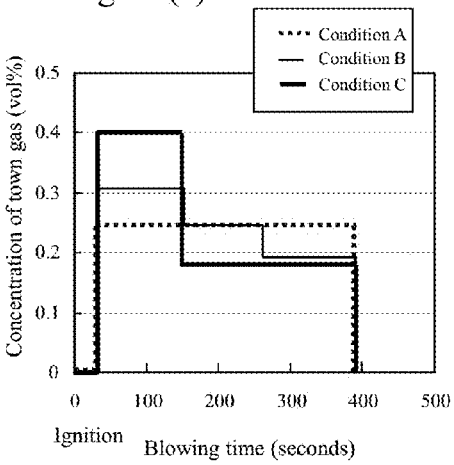
FIGS. 11(*a*) and (*b*) are graphs showing simulation results of a temperature history at a position of 50 mm depth from a surface of a charged layer according to a supplying way of a gaseous fuel.
Figure 11B:
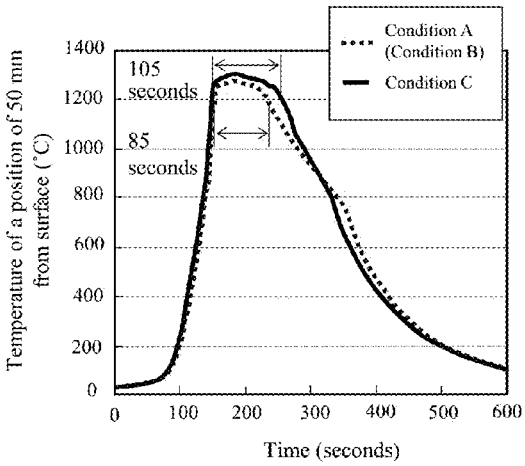

Moreover, when the total amount of the gaseous fuel supplied is same as shown in FIG. 11(*a*), the simulation is conducted under 3 conditions: i.e. a condition that the concentration of the gaseous fuel supplied is constant of 0.25 vol % for the above gaseous fuel supplying time (6 minutes) (condition A); a condition that the concentration of the gaseous fuel supplied is decreased sequentially to 0.31 vol %, 0.25 vol %, 0.19 vol % from the upstream side toward the downstream side for the above gaseous fuel supplying time (6 minutes) (condition B); and a condition that the gaseous fuel is intensively supplied at a high concentration (0.4 vol %) for the first 2 minutes when the sintering reaction proceeds in the outermost surface portion of the raw material charged layer and then supplied at a low concentration (0.18 vol %) for subsequent 4 minutes (condition C).

FIG. 11(*b*) shows simulation results of condition A supplying the gaseous fuel at a constant concentration and condition C intensively supplying the gaseous fuel at the upstream side. As seen from this figure, in condition C intensively supplying the gaseous fuel at the upstream side, the maximum achieving temperature is 1296° C., which is 21° C. higher than 1275° C. in condition A, and the time kept at not lower than 1200° C. (high-temperature keeping time) is also prolonged from 85 seconds to 105 seconds. In condition B gradually decreasing the concentration of the gaseous fuel supplied, the maximum achieving temperature is raised as compared to that in condition A, and the high-temperature keeping time is prolonged, but both the conditions are not much different. From these results, it is assumed that to raise the sintering temperature in the outermost surface portion of the raw material charged layer, if the amount of the gaseous fuel supplied (heat generation amount) is the same, it is effective to intensively supply the gaseous fuel especially in the front half portion (upstream side portion) of the gaseous fuel supplying region.

Next, for the purpose of confirming the results of the above simulations, we conducted a sintering experiment wherein the sintering is conducted by filling sintering raw material at a layer thickness of 380 mm into a test pot having an inner diameter of 300 mmϕ and a height of 400 mm shown in FIG. 12(*b*) to form a charged layer, igniting the surface of the charged layer with an ignition burner, and sucking air with a blower disposed below the test pot and not shown under a negative pressure of −700 $mmH_2O$.

Figure 12A:
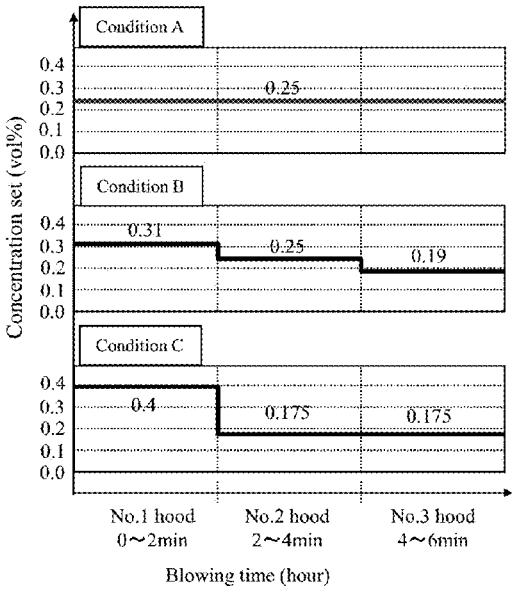
FIGS. 12(*a*) and (*b*) are views illustrating conditions of a sintering experiment simulating an actual sintering machine.
Figure 12B:
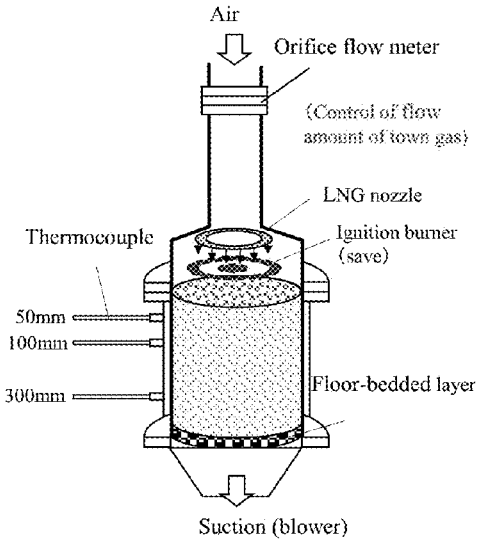

Assuming that the gaseous fuel is supplied from three gaseous fuel supplying apparatuses installed in the actual sintering machine, the supply of the gaseous fuel (LNG) from a nozzle disposed above the charged layer is conducted under three conditions after 30 seconds of the ignition as shown in FIG. 12(*a*), i.e. a condition A that LNG of 0.25 vol % is supplied for 2 minutes from each apparatus (for 6 minutes in total), a condition B that LNG is supplied from each apparatus while gradually decreasing from 0.31 vol % to 0.25 vol % and further 0.19 vol %, and a condition C that LNG of a high concentration (0.4 vol %) is supplied from the first apparatus and LNG of a low concentration (0.18 vol %) is supplied from each of the remaining two apparatuses.

In the above sintering experiment, a thermocouple is inserted at each position of 50 mm, 100 mm and 300 mm from the outermost surface of the raw material charged layer to measure the temperature history at each position during the sintering. In the sintering experiment, the time required for sintering is also measured, while the shatter strength SI of the obtained sintered ore (mass % of particles having a particle size of not less than 10 mm when being sieved after the drop test) is measured according to JIS M8711, and the productivity of the sintered ore is determined from these measured values.

In FIG. 13 are shown the temperature results measured on condition A and condition C at each position of 50 mm, 100 mm and 300 mm from the outermost surface of the raw material charged layer. Moreover, the results of condition B are superior to those of condition A, but both the conditions are not much different. As seen from this figure, in condition A supplying the gaseous fuel at a constant concentration and condition B sequentially decreasing the concentration of the gaseous fuel supplied from the upstream side to the downstream side, the maximum achieving temperature at a position of 50 mm from the surface is lower than 1200° C. (the high-temperature keeping time=0), while in condition C intensively supplying the gaseous fuel on the upstream side, the maximum achieving temperature is 1265° C. and the high-temperature keeping time is ensured to be approximately 1 minute (50 seconds). Moreover, in condition C, the maximum achieving temperature at a position of 100 mm from the surface is raised and the prolongation of the high-temperature keeping time is attained.

FIG. 14 shows the results of sintering time, shatter strength and productivity obtained under each of conditions A and C. Moreover, the results of condition B are superior to those of condition A, but there is no difference from condition A. As seen from FIG. 14, the sintering time is somewhat prolonged in condition C intensively supplying the gaseous fuel on the upstream side as compared to condition A supplying the gaseous fuel at a constant concentration and condition B sequentially decreasing the concentration, while the strength of the sintered ore (shatter strength) is increased to cause an improvement of about 3% in the productivity. From these results, it can be seen that if the amount of the gaseous fuel supplied (heat generation amount) is same, the high-quality sintered ore can be produced with a high productivity by intensively supplying the gaseous fuel at the front half portion (upstream side portion) of the gaseous fuel supply region.

It is necessary that the gaseous fuel is supplied in a region wherein the time kept at the maximum achieving temperature of not lower than 1200° C. during the sintering in the raw material layer cannot be ensured for not less than 150 seconds, that is, a region wherein the high-temperature keeping time is less than 150 seconds. The length of this region is varied depending on the specification of the sintering machine or the operational conditions of the sintering, but is generally about 30% of the front side (upstream side) of a machine length ranging from the ignition furnace to the ore removing portion (effective machine length).

Even in the region wherein the high-temperature keeping time is less than 150 seconds, the high-temperature keeping time tends to be more decreased on the front side (the upstream side). Therefore, when the gaseous fuel is supplied from a viewpoint of compensating heat generation amount intensively on a region having a short high-temperature keeping time, it is required to supply more than 50% of the total supply of the gaseous fuel on a front ½ portion of the gaseous fuel supply region, and preferably it is desirable to supply not less than 65% on such a portion.

When the gaseous fuel is supplied intensively on the upstream side, to more enhance the effect, the region supplying the gaseous fuel at a high concentration is preferable to be a front ⅓ portion of the gaseous fuel supply region instead of the front ½ portion. In this case, it is more preferable to supply more than 40% of the total supply of the gaseous fuel in such a portion.

Also, the supply of the gaseous fuel is preferable to start on a downstream side of not less than 3 m from the outlet side of the ignition furnace (not less than 75 seconds after the ignition). When it is too close to the ignition furnace, the gaseous fuel is supplied at a state of existing a source of fire on the outermost surface of the charged layer so that there is a fear that combustion occurs before the introduction into the raw material charged layer.

The gaseous fuel is not limited to the aforementioned LNG (natural gas), and can preferably be, for example, a by-product gas of an ironworks such as blast furnace gas (B gas), coke oven gas (C gas), a mixed gas of blast furnace gas and coke oven gas (M gas) or the like, a flammable gas such as town gas, methane gas, ethane gas, propane gas or the like and a mixture gas thereof. Moreover, unconventional natural gas (shale gas) collected from a shale layer and different from the conventional natural gas can be used like LNG.

The gaseous fuel contained in air introduced into the charged layer is necessary to have a concentration of not more than the lower limit of combustion concentration of the gaseous fuel. When the concentration of the diluted gaseous fuel is higher than the lower limit of combustion concentration, it is combusted above the charged layer, so that there is a fear of losing the supplying effect of the gaseous fuel or causing explosion. On the other hand, when the concentration of the diluted gaseous fuel is high, it is combusted in a low-temperature zone. Hence, there is a fear that the gaseous fuel may not contribute to the prolongation of the high-temperature keeping time effectively. The concentration of the diluted gaseous fuel is preferably not more than ¾ of the lower limit of combustion concentration at room temperature in air, more preferably not more than ⅕ of the lower limit of combustion concentration, further preferably not more than 1/10 of the lower limit of combustion concentration. However, when the concentration of the diluted gaseous fuel is less than 1/100 of the lower limit of combustion concentration, heat generation amount by the combustion is lacking and the effects of increasing the strength of sintered ore and improving the yield cannot be obtained so that the lower limit is set to be 1/100 of the lower limit of combustion concentration. With regard to the natural gas (LNG), since the lower limit of combustion concentration of LNG at room temperature is 4.8 vol %, the concentration of the diluted gaseous fuel is preferably 0.05~3.6 vol %, more preferably 0.0~1.0 vol %, further preferably in a range of 0.05~0.5 vol %. As the method of supplying the diluted gaseous fuel may be used either of a method of supplying air containing a gaseous fuel previously diluted to not more than the lower limit of combustion concentration or a method of ejecting a gaseous fuel with a high concentration into air at a high speed to instantly dilute to not more than the lower limit of combustion concentration.

To obtain a sintered ore having an excellent reduction degradation index (RDI), a high strength and an excellent reducibility, it is important that calcium ferrite produced at a temperature of not lower than 1200° C. is not decomposed into calcium silicate and secondary hematite. To this end, it is important that the temperature in the charged layer is kept at not lower than 1200° C. (solidus temperature of calcium ferrite) for a long time without exceeding the maximum achieving temperature in the charged layer during sintering over 1400° C., preferably 1380° C. In the method of producing the sintered ore, therefore, it is preferable that the region supplying the gaseous fuel is applied to a region where the high-temperature keeping time kept at not lower than 1200° C. but not higher than 1380° C. is less than 150 seconds when the sintering is performed by combustion heat of only the carbonaceous material to thereby attain the prolongation of the high-temperature keeping time.

EXAMPLE

By using an actual sintering machine with a pallet width of 5 m and a length ranging from an ignition furnace to an ore removing portion (effective machine length) of 82 m and provided at a position of about 4 m downstream side of the ignition furnace with three gaseous fuel supplying apparatuses of 7.5 m in length (about 30% of effective machine length) in series is conducted a sintering experiment wherein LNG as a gaseous fuel is supplied from the gaseous fuel supplying apparatuses at a concentration of not more than the lower limit of combustion concentration into the charged layer for combustion.

The concentration of LNG is varied as shown in Table 2. T1 is the conventional sintering condition wherein the sintering is conducted only by combustion heat of carbonaceous material (Comparative Example 1), T2 is a condition wherein LNG of 0.25 vol % being not more than the lower limit of combustion concentration is supplied from all of the three gaseous fuel supplying apparatuses (Comparative Example 2), T3 is a condition wherein LNG is supplied at a rate of 0.40 vol % from the most upstream gaseous fuel supplying apparatus and at a rate of 0.175 vol % from the remaining two gaseous fuel supplying apparatuses, respectively (Example 1), T4 is a condition wherein LNG is supplied at a rate of 0.50 vol % from the most upstream gaseous fuel supplying apparatus, 0.15 vol % from the subsequent gaseous fuel supplying apparatus, and 0.10 vol % from the most downstream gaseous fuel supplying apparatus, respectively (Example 2), and T5 is a condition wherein LNG is supplied at a rate of 0.60 vol % from the most upstream gaseous fuel supplying apparatus, 0.075 vol % from the subsequent gaseous fuel supplying apparatus and 0.075 vol % from the most downstream gaseous fuel supplying apparatus, respectively (Example 3). In the conventional sintering condition (Comparative Example), the amount of the carbonaceous material supplied into the sintering raw material is 5.0 mass %, and when the diluted gaseous fuel is supplied, the amount of the carbonaceous material is reduced to 4.7 mass % to prevent the maximum achieving temperature from exceeding over 1400° C.

In the above sintering experiment, the time required to sinter is measured and at the same time the shatter strength SI of the obtained sintered ore (mass % of particles having a particle size of not less than 10 mm when being sieved after a drop test) according to JIS M8711, the yield of the product sintered ore, and the generation rate of the returned ore are determined, results of which are also shown in Table 2. From these results, it is confirmed that the strength of the sintered ore (shatter strength) is increased and the yield is improved under the condition of intensively supplying the gaseous fuel on the upstream side even in the actual sintering machine.

INDUSTRIAL APPLICABILITY

The sintering method is useful as a method of producing a sintered ore used for iron-making, particularly as a raw material for a blast furnace, but also can be utilized as the other method for forming ore agglomerate.

The invention claimed is:

1. A method of producing a sintered ore comprising:

charging a sintering raw material containing a powder ore and a carbonaceous material onto a circulatory moving pallet to form a charged layer, igniting the carbonaceous material on a surface of the charged layer, introducing air above the charged layer containing a gaseous fuel diluted to not more than a lower limit of combustion concentration with wind boxes arranged below the pallet into the charged layer by suction, and combusting the gaseous fuel and the carbonaceous material in the charged layer, wherein the region supplying the gaseous fuel is a region wherein a high-temperature keeping time kept at not lower than 1200° C. but not higher than 1380° C. is less than 150 seconds when the area is sintered by combustion heat of only the carbonaceous material, and wherein more than 50% of a total supply of the gaseous fuel is supplied in a front ⅓ portion of a region supplying the gaseous fuel.

2. The method according to claim 1, wherein the region supplying the gaseous fuel is not more than 40% of a machine length ranging from an ignition furnace to an ore removing portion.

TABLE 2

| | Experiment level | | | | | | | | | | | | |
|---|---|---|---|---|---|---|---|---|---|---|---|---|---|
| | T1 | T2 | | | T3 | | | T4 | | | T5 | | |
| Amount of carbonaceous material (coke) (mass %) | 5.0 | 4.7 | | | 4.7 | | | 4.7 | | | 4.7 | | |
| No. of gaseous fuel supplying apparatuses (from the upstream side) | — | 1 | 2 | 3 | 1 | 2 | 3 | 1 | 2 | 3 | 1 | 2 | 3 |
| Concentration of gaseous fuel (LNG) supplied (vol %) | — | 0.25 | 0.25 | 0.25 | 0.40 | 0.175 | 0.175 | 0.50 | 0.15 | 0.10 | 0.6 | 0.075 | 0.075 |
| Supply rate of gaseous fuel (%) | — | 33.3 | 33.3 | 33.3 | 53.0 | 23.5 | 23.5 | 66.7 | 20.0 | 13.3 | 80.0 | 10.0 | 10.0 |
| | — | 50 | 50 | | 65 | 35 | | 76.7 | 23.3 | | 85.0 | 15.0 | |
| Strength SI of product sintered ore (%) | 89.2 | 89.7 | | | 92.0 | | | 92.3 | | | 92.5 | | |
| Yield of product sintered ore (%) | 76.8 | 78.1 | | | 80.3 | | | 80.5 | | | 81.0 | | |
| Generation rate of returned ore (%) | 23.2 | 20.1 | | | 19.3 | | | 18.8 | | | 18.2 | | |
| Remarks | Comparative Example 1 | Comparative Example 2 | | | Invention Example 1 | | | Invention Example 2 | | | Invention Example 3 | | |

3. The method according to claim 2, wherein the concentration of the gaseous fuel contained in air introduced in the charged layer is not more than the lower limit of combustion concentration.

4. The method according to claim 1, wherein the concentration of the gaseous fuel contained in air introduced in the charged layer is not more than the lower limit of combustion concentration.

* * * * *